US006262700B1

(12) United States Patent
Ueoka

(10) Patent No.: US 6,262,700 B1
(45) Date of Patent: Jul. 17, 2001

(54) METHOD FOR DRIVING PLASMA DISPLAY PANEL

(75) Inventor: Mitsuo Ueoka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/252,887

(22) Filed: Feb. 18, 1999

(30) Foreign Application Priority Data

Feb. 25, 1998 (JP) ..... 10-042707

(51) Int. Cl.[7] ..... G09G 3/28
(52) U.S. Cl. ..... 345/68; 345/37; 345/63
(58) Field of Search ..... 345/37, 41, 42, 345/60–72; 315/169.4

(56) References Cited

U.S. PATENT DOCUMENTS

| | | | | |
|---|---|---|---|---|
| 5,420,602 | * | 5/1995 | Kanazawa | 345/67 |
| 5,436,634 | * | 7/1995 | Kanazawa | 345/67 |
| 5,541,618 | * | 7/1996 | Shinoda | 345/60 |
| 5,724,054 | * | 3/1998 | Shinoda | 345/60 |
| 5,835,072 | * | 11/1998 | Kanazawa | 345/60 |
| 5,874,932 | * | 2/1999 | Nagaoka et al. | 345/60 |
| 5,889,501 | * | 3/1999 | Sasaki et al. | 345/60 |
| 5,936,355 | * | 8/1999 | Kim | 315/169.4 |
| 6,097,357 | * | 8/2000 | Shinoda et al. | 345/63 |

FOREIGN PATENT DOCUMENTS

| | | |
|---|---|---|
| 0 549 275 | 6/1993 | (EP) . |
| 0 657 861 | 6/1995 | (EP) . |
| 0 680 067 | 11/1995 | (EP) . |

* cited by examiner

*Primary Examiner*—Stevens Saras
*Assistant Examiner*—Srilakshmi Kumar
(74) *Attorney, Agent, or Firm*—Sughrue, Mion, Zinn, Macpeak & Seas, PLLC

(57) ABSTRACT

Focusing attention on a new fact that a difference in the operating margin between sub-fields becomes remarkable when preliminary discharge is not provided for all sub-fields, but is thinned out, the operating margin for a plasma display panel will be improved by restricting the difference in the operating margin.

In the case of the thinned preliminary discharge system, particularly the dependence of maintenance blanking characteristics on the maintenance pulse number becomes remarkable and as a result, the operating margin difference among the sub-fields becomes remarkable, and therefore, parameters for blanking pulse of the sub-field during the maintenance blanking period are set in conformity with the maintenance pulse number (number of times of emission) for each sub-field in order to restrain this operating margin difference.

10 Claims, 9 Drawing Sheets

METHOD FOR DRIVING PLASMA DISPLAY PANEL

BACKGROUND OF THE INVENTION

1. Field of the Invention

The present invention relates to a method for driving a plasma display panel, and more particularly, to a method for driving a color plasma display panel capable of tonal display by dividing one field into a plurality of sub-fields to set the number of times of emission for each sub-field to different values.

2. Description of the Related Art

Conventionally, the tonal display on a plasma display panel has been implemented by controlling a number of times of discharge (emission luminance) during a maintenance period as shown in FIG. 11. More specifically, one field (F), which displays one screen, is repeated 50 to about 70 times a second, whereby screens of the respective fields are stacked by means of afterimages of a human eye and a flicker-free natural image can be obtained. This one-field period is divided into a plurality of sub-fields (SF), and these sub-fields are combined by varying a maintenance pulse number (a number of times of discharge) during the maintenance period of each sub-field to thereby implement tonal display.

In, for example, display of 64 shades of gray, as shown in FIG. 11, one field is constituted by six sub-fields: SF1 to SF6, and a preliminary discharge period (preliminary lighting period+blanking period) is provided at the head of each sub-field, and subsequent to this period, there are provided a write period and a maintenance period respectively. The weighting is effected by reducing the number of times of discharge during these maintenance periods by about ½ for each successive sub-field, from the sub-field at the head (in SF1, the number of times of discharge is assumed to be 32n where n is a positive integer).

When the foregoing sub-field is selected within one frame for maintenance discharge in accordance with this method, the emission luminance can be controlled by the number of times of maintenance discharge in the sub-field selected, and therefore, the display of 64 shades of gray can be implemented.

In this respect, FIG. 12 is a sectional view showing a general plasma display panel. In FIG. 12, reference numeral 1 designates a front substrate; 2*a,* a scanning electrode; 2*b,* a maintenance electrode; 3, a bus electrode; 4, a dielectric layer; 5, a rear substrate; 6, a data electrode; 7, a white dielectric body; 8, fluorescent material; and 9, a discharge cell respectively.

If the preliminary discharge periods are provided at the heads of all the sub-fields as described above, preliminary discharge occurs at least six times even in a non-display portion to cause light emission over the entire screen. This emission causes black float particularly in a dark place, thereby deteriorating the contrast. Also, if the sub-fields are arranged simply in decreasing order of the weighting of emission luminance (number of times of discharge) as shown in FIG. 11, a pseudo contour may appear on displaying a moving image.

In order to suppress these defects, a driving sequence, as shown in FIG. 1, is used (this driving sequence diagram in FIG. 1 is the same as that for the present invention), in which this preliminary discharge is applied once per field, and the sub-fields are not arranged simply in decreasing order of the weighting of emission luminance (number of times of discharge), but their sequence has been determined by contriving. In such driving sequence, the preliminary discharge period is provided only for the sub-field SF6 at the head, and the sub-field SF6 is constituted by the preliminary discharge period, a write period, a maintenance period and a maintenance blanking period. Each of the sub-fields SF1 to 5 other than the sub-field SF6 is constituted by a write period, a maintenance period and a maintenance blanking period.

In such driving sequence in which preliminary discharge is provided for all sub-fields as shown in FIG. 11, the sequence, in which light is certainly emitted over the entire screen at the beginning of each sub-field for blanking, is adopted, and therefore, the presence or absence of wall charge, which is caused by the presence or absence of maintenance discharge of the sub-field in question, is bound to be erased, and does not affect the next sub-field. In contrast, however, in such driving sequence, in which the preliminary discharge is thinned out, as shown in FIG. 1, the presence or absence of the maintenance discharge during a maintenance period of the sub-field in question remains as a difference in wall charge on the scanning electrode and maintenance electrode, and therefore, the blanking characteristics of a maintenance blanking period provided at the last of the sub-field becomes important as one of the elements for determining the operating margin.

However, wall charge has conventionally been blanked by the use of microdischarge using wall charge during the maintenance blanking period, and therefore, the maintenance blanking period is susceptible to the amount of wall charge, and the blanking characteristics easily becomes unstable. Therefore, when it is adopted, such sub-field driving sequence as shown in FIG. 1 is defective, in that the operating margin is lowered and the yield is reduced as compared with the conventional method in which all sub-fields are provided with preliminary discharge.

FIG. 13 shows the dependence of the operating margin in driving sequence in sub-fields of FIG. 1 on the sub-field. The "minimum operating voltage" in this figure is the minimum value of the drivable voltage, and the "maximum operating voltage" is the maximum value of the drivable voltage. This operable voltage range is the operating margin. When voltage exceeding this operating margin is applied, an erroneous display occurs, and when voltage below the operating margin is applied, a non-display portion occurs. From this figure, it can be seen that the operating margin of the sub-field next to a sub-field having low weighting of emission luminance is lowered.

In other words, SF4, which is next to SF6 having the minimum emission luminance, has the highest minimum operating voltage, and the lowest maximum operating voltage. From this figure, therefore, it can also be seen that the operating margin for the entire plasma display panel is regulated by SF4 to be narrowed. The sub-field SF4, which is next to SF6 having the minimum emission luminance, has the minimum operating margin. This is because the intensity of the maintenance discharge during a maintenance period prior to the maintenance blanking period is affected by the maintenance pulse number constituting the maintenance period.

As shown in FIG. 14, the maintenance discharge during the maintenance period becomes stronger with the number of maintenance pulses PSUS to be applied, and will be saturated. Therefore, when the number of maintenance pulses is as small as 1 piece (case of n=1) like SF6, the maintenance discharge does not become strong during the maintenance period. On the other hand, at SF3, which follows SF1, the maintenance discharge becomes strong because the number of maintenance pulses at SF1 is as sufficiently great large as 32 pieces (case of n=1).

Since the number of the maintenance pulses differs depending on the sub-field as described above, the intensity of the maintenance discharge differs, and the amounts of wall charge which are produced by the respective sub-fields during the maintenance period are different from one another. Since these different wall charge have been blanked (neutralized) during the maintenance blanking period having the same maintenance blanking pulse, the blanking (neutralization) of the wall charge becomes insufficient in a sub-field having a small number of maintenance pulses, leading to decrease in the foregoing operating margin.

In this respect, a driving method in which the preliminary discharge is not provided for all the sub-fields, but the number of times of preliminary discharge per field is reduced in an attempt to enhance the display contrast, is discussed in Japanese Patent Application Laid-Open Nos. 4-280289 and 7-49663. Also, a conventional example in which the waveform of the blanking pulse has been contrived in order to obtain sufficient blanking characteristics even if there are variations in the characteristics of the discharge cell, is discussed in Japanese Patent Application Laid-Open Nos. 8-30228 and 9-160522. They are aimed to eliminate variations in the blanking characteristics within one field and discharge cell.

SUMMARY OF THE INVENTION

The present invention is directed to on a new fact that in a case where the preliminary discharge is not provided for all the sub-fields (case of thinned preliminary discharge system in which preliminary discharge has been thinned out), particularly the dependence of the maintenance blanking characteristics on the maintenance pulse number becomes significant and as a result, an operating margin difference among the sub-fields becomes significant. One object of the present invention is to improve the operating margin of the plasma display panel by restraining this operating margin difference.

According to the present invention, there is provided a method for driving a plasma display panel for dividing one field period displaying one screen of a plasma display panel into a plurality of sub-fields, and setting a number of times of light emission in each sub-field thus divided (setting a maintenance pulse member in each sub-field) to different values for tonal display, each of the foregoing sub-fields having at least a write period, a maintenance period and a maintenance blanking period, wherein parameters for blanking pulses (blanking parameters of blanking pulses) during the foregoing maintenance blanking period are set in conformity with the foregoing number of times of emission (maintenance pulse number) during the foregoing maintenance period.

The foregoing maintenance blanking period is characterized in that a plurality of blanking parameters constituting the maintenance blanking period are at least one of the foregoing number of blanking pulses, crest value, pulse width and rise time, and that the preliminary discharge periods are thinned out and provided for a subset of sub-fields instead of being provided for all sub-fields.

Further, the present invention is characterized in that the sequence of the foregoing sub-fields within one field is arranged so as to be different from the decreasing order of the number of times of emission, that the foregoing blanking pulse is a bipolar pulse having positive and negative polarities, and further that the foregoing blanking pulse is supplied to the scanning electrode and a common maintenance electrode.

The operation of the present invention will be described. In the case of the so-called thinned preliminary discharge system, in which preliminary discharge is not provided for all sub-fields, particularly, the dependence of the maintenance blanking characteristics on the maintenance pulse number becomes significant and as a result, the operating margin difference among the sub-fields becomes significant. Therefore, the parameters for blanking pulses of the sub-fields during the maintenance blanking period are set in conformity with the maintenance pulse number (number of times of emission) for each sub-field in order to suppress the operating margin difference.

DESCRIPTION OF THE PREFERRED EMBODIMENT

Hereinafter, embodiments of the present invention will be described in detail in conjunction with the drawings.

Figure 1:
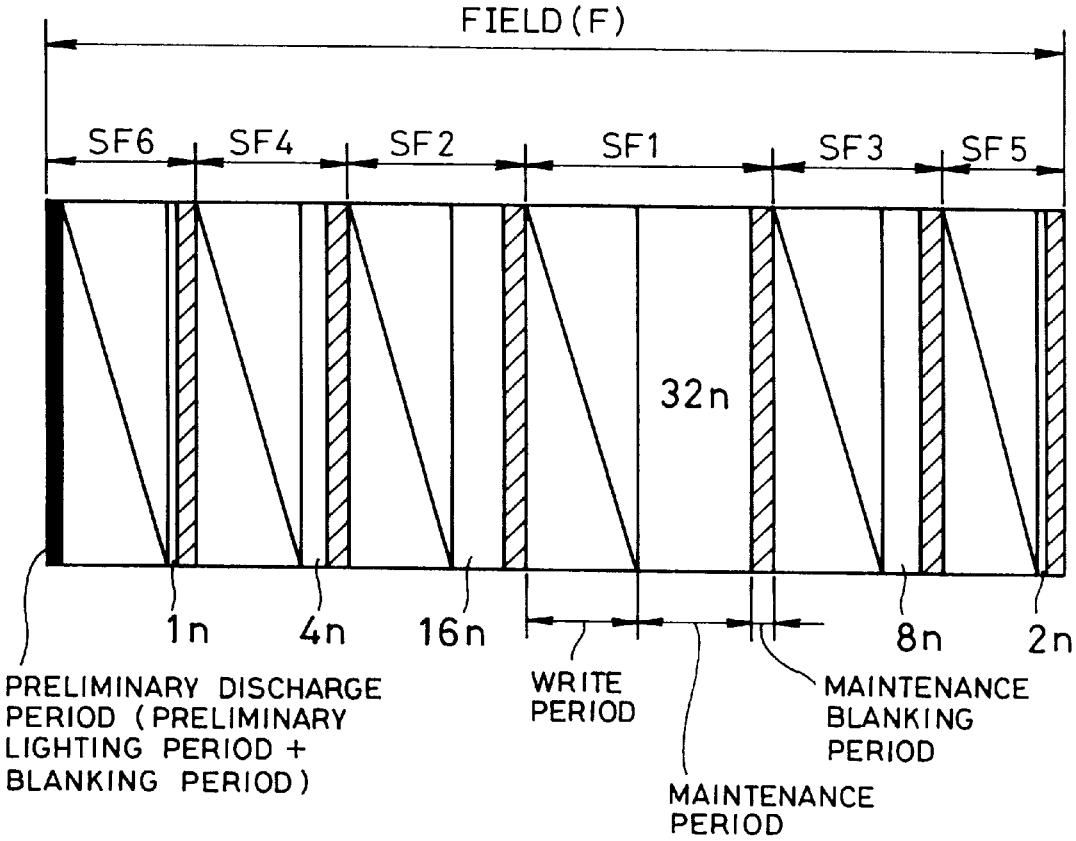
FIG. 1 is a view showing structure of one field for explaining an embodiment according to the present invention.

FIG. 1 shows the sub-frame structure of one field according to an embodiment of the present invention and an example of driving sequence, upon first glance this driving sequence causes this example to appear to be the same as the foregoing conventional thinned preliminary discharge system. However, parameters (pulse number, crest value, pulse width, rise time, etc.) of blanking pulses during the maintenance blanking period in each sub-field have been set so as to be different respectively in response to the number of times of emission during the maintenance period of each sub-field.

In order to perform tonal display, one field is structured so as to be divided into six sub-fields: SF1 to SF6, and with the aim of improving the contrast and preventing any pseudo contour from occurring during display of a moving image, the number of times of preliminary discharge is set to once a field, and the sequence of the sub-fields is changed from the simple order of the weighting of emission luminance during the maintenance period.

More specifically, as shown in FIG. 1, the sequence is: SF6 (weighting of emission luminance: 1n), SF4 (weighting: 4n), SF2 (weighting 16n), SF1 (weighting: 32n), SF3 (weighting: 8n) and SF5 (weighting: 2n). The "n" is a positive integer. However, this sequence is exemplary, and the driving sequence is not limited thereto. In this respect, the weighting of this emission luminance is effected on the basis of the number of maintenance pulses constituting the maintenance period in the same manner as before.

Figure 11:
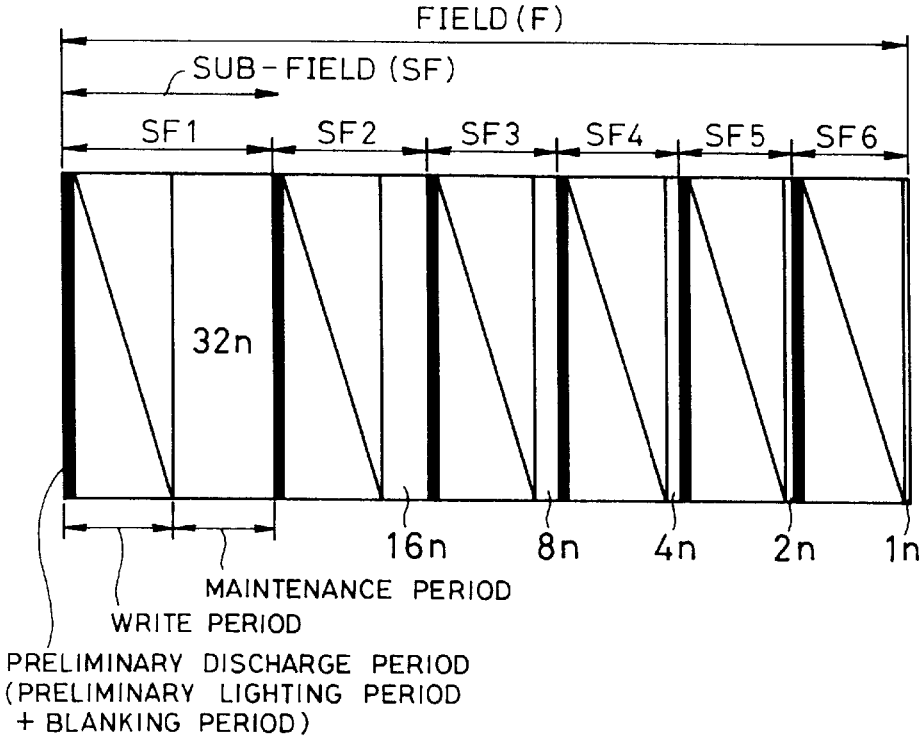
FIG.11 (PRIOR ART)
FIG. 11 is a view showing the structure of 1 field for explaining an example of a conventional method for driving a plasma display panel.
Figure 12:
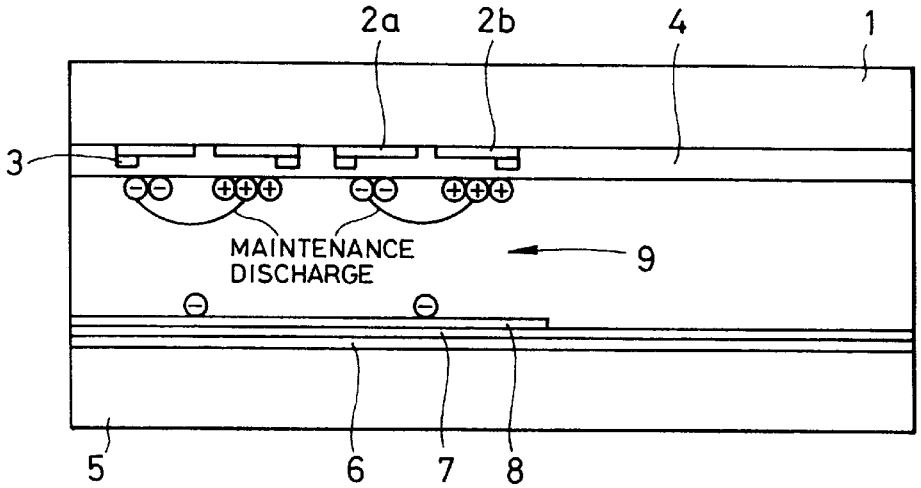
FIG.12 (PRIOR ART)
FIG. 12 is a sectional view showing a general plasma display panel.
Figure 13:
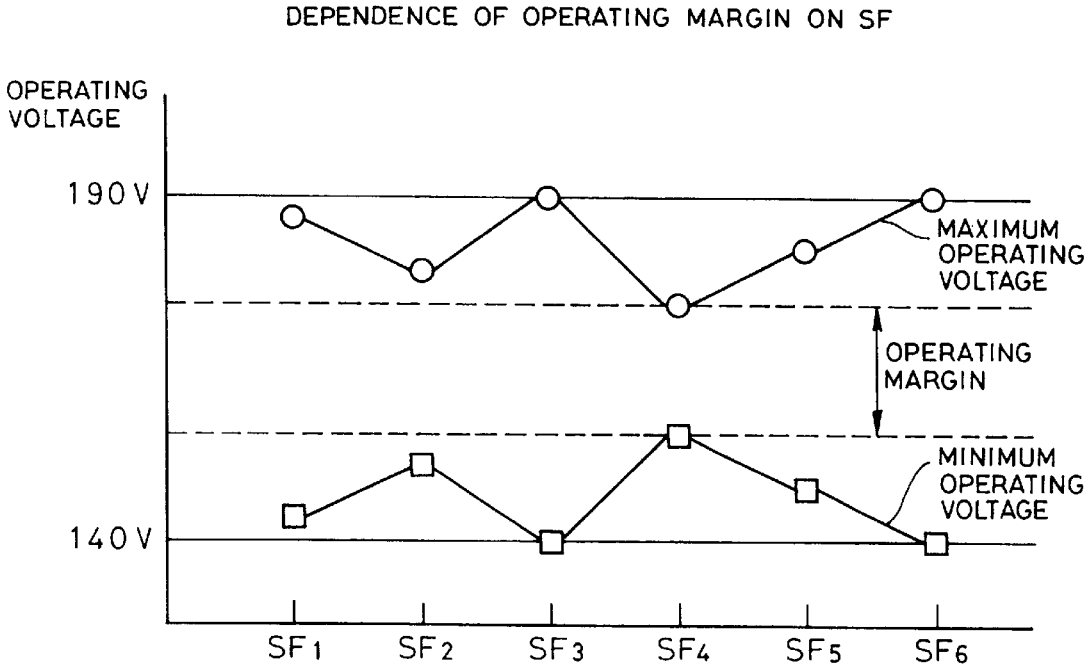
FIG.13 (PRIOR ART)
FIG. 13 is a view showing the dependency of the operating margin in the sub-field structure of the thinned preliminary discharge system on the sub-field.
Figure 14:
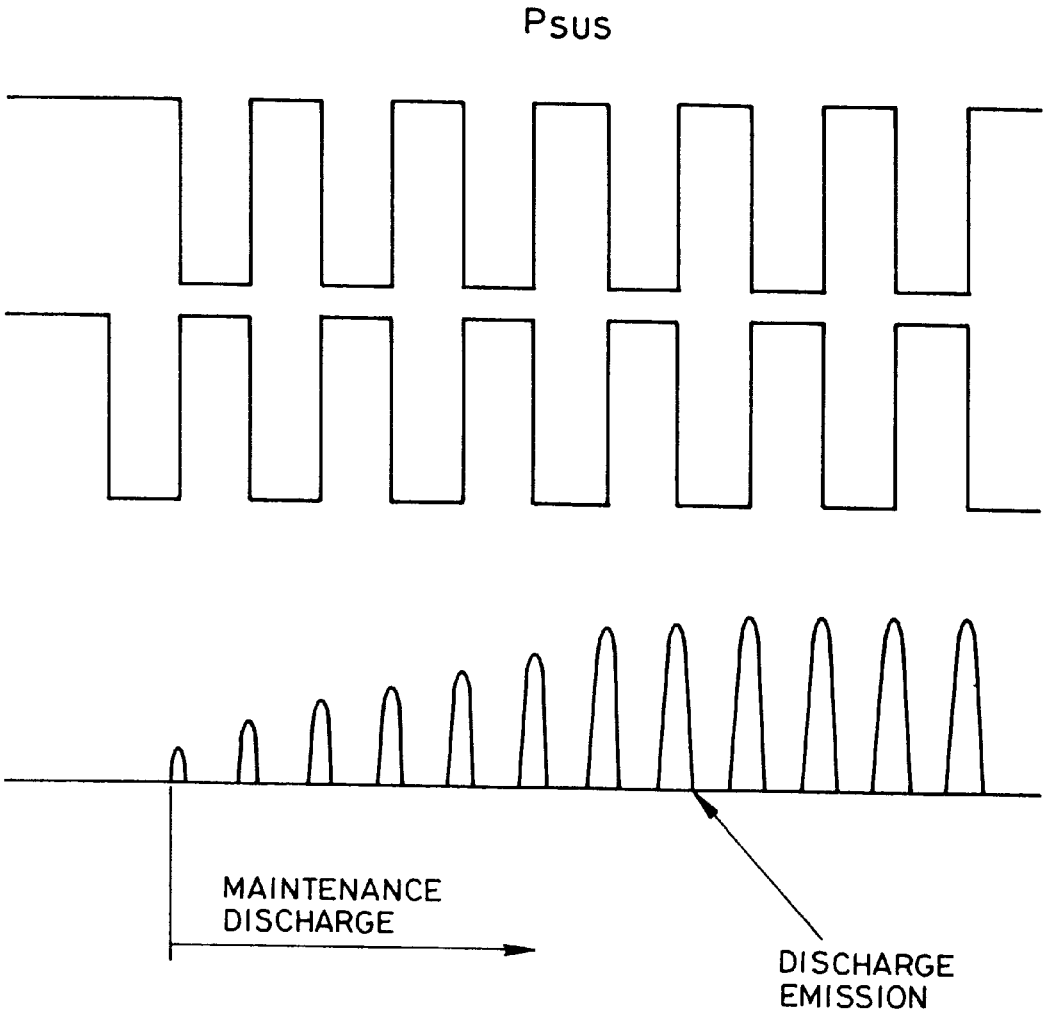
FIG.14 (PRIOR ART)
FIG. 14 is a view showing an aspect of maintenance discharge during the maintenance period in the structure of FIG. 13 to the maintenance pulse.

The structure of each of these sub-fields will be described below. The preliminary discharge period is provided only for the sub-field SF6 at the head, and the sub-field SF6 comprises a write period, a maintenance period and a maintenance blanking period which follow the preliminary discharge period. Each of sub-fields SF1 to 5 other than the sub-field SF6 comprises a write period, a maintenance period and a maintenance blanking period. In this respect, the preliminary discharge period comprises a preliminary lighting period and a preliminary blanking period which display the entire display screen in the same manner as in the example of FIG. 11.

Figure 2:
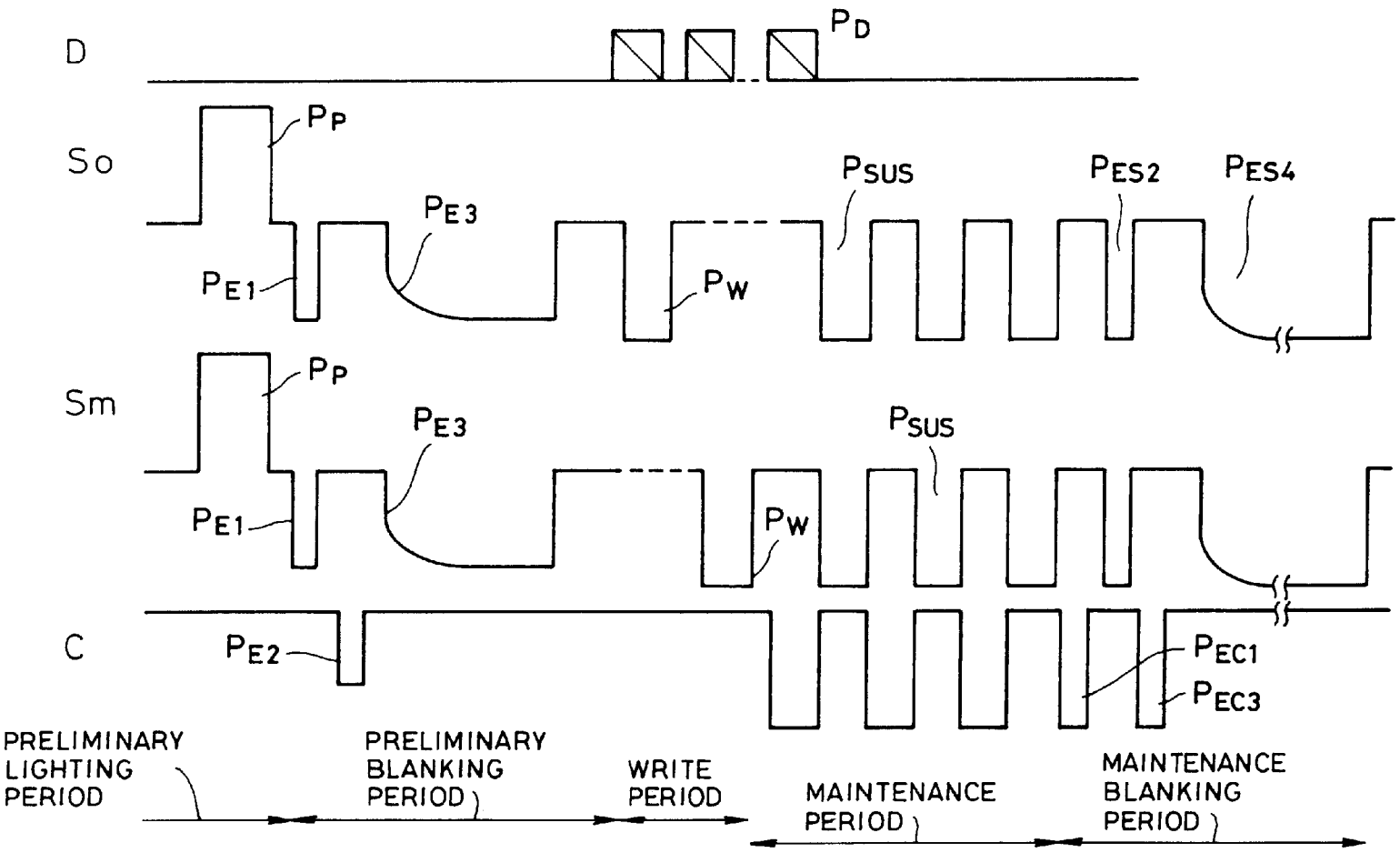
FIG. 2 is a view showing examples of waveform at each portion for explaining the operation in the embodiment according to the present invention.

FIG. 2 shows a part of driving waveforms for sub-fields SF6 and SF4. As the driving waveform, there are shown three types: a pulse train D which is applied to the data electrode; pulse trains S0 and Sm which, of a plurality of scanning electrodes, are applied to the 0-th one and m-th one; and a pulse train C which is applied to the common maintenance electrode.

Figure 3:
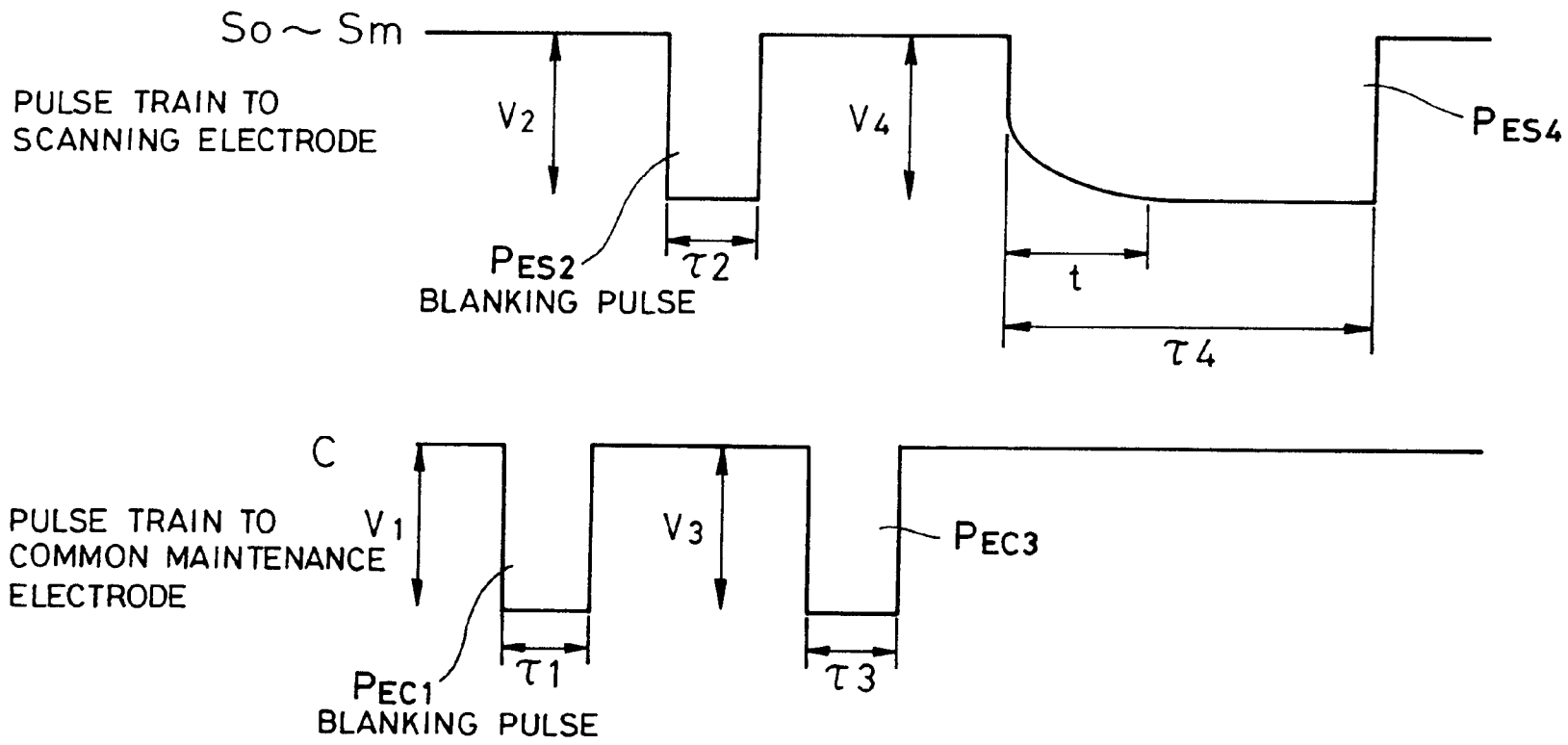
FIG. 3 is a partially enlarged view of FIG. 2.
Figure 4:
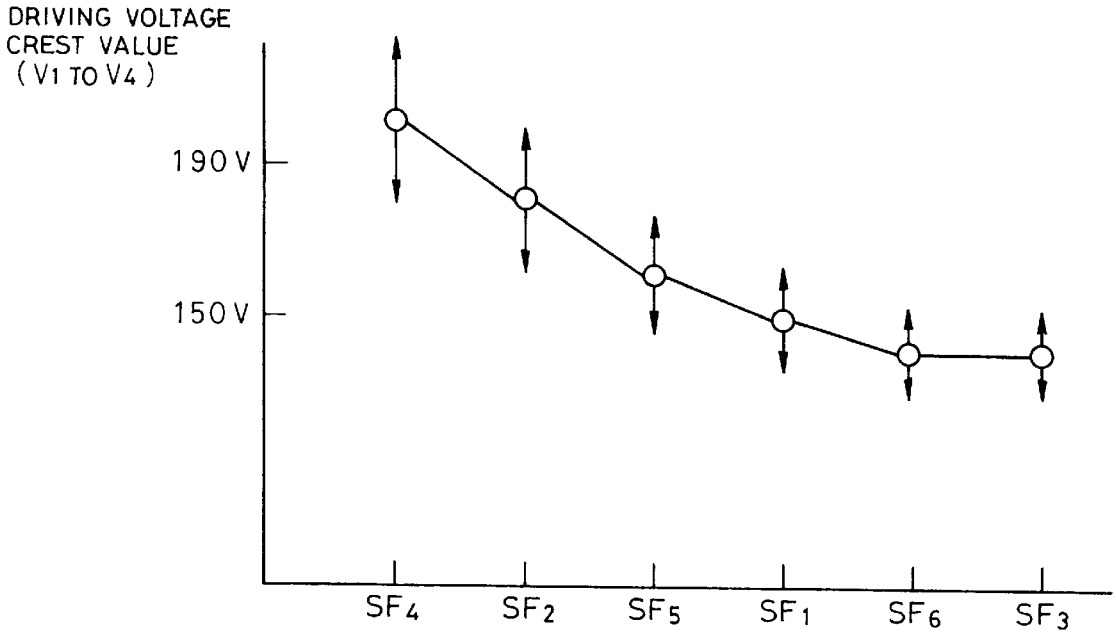
FIG. 4 is a view showing a margin for driving voltage crest value for a blanking pulse.
Figure 5:
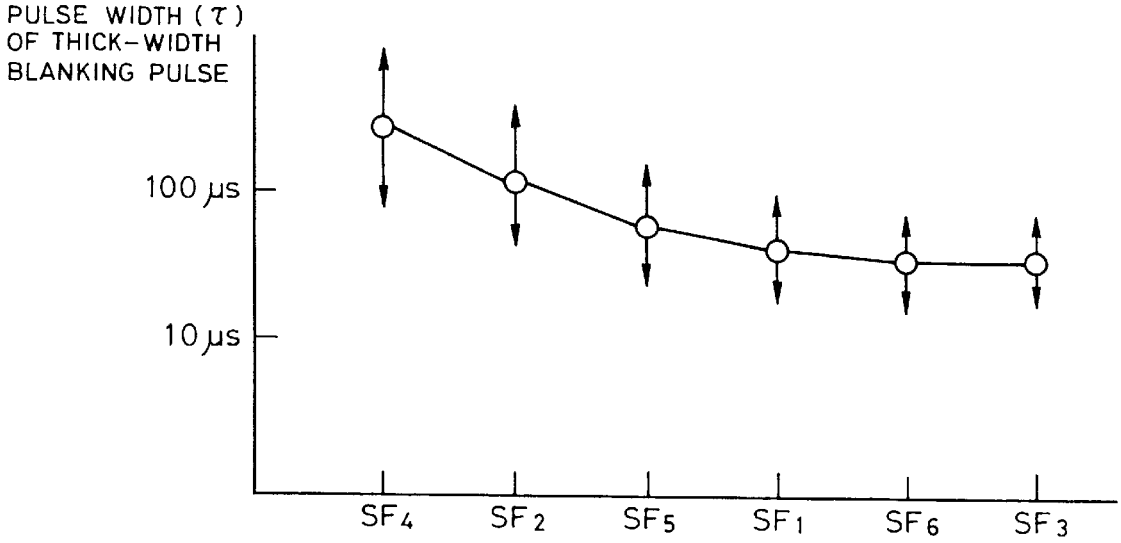
FIG. 5 is a view showing a margin for pulse width of a thick-width blanking pulse.
Figure 6:
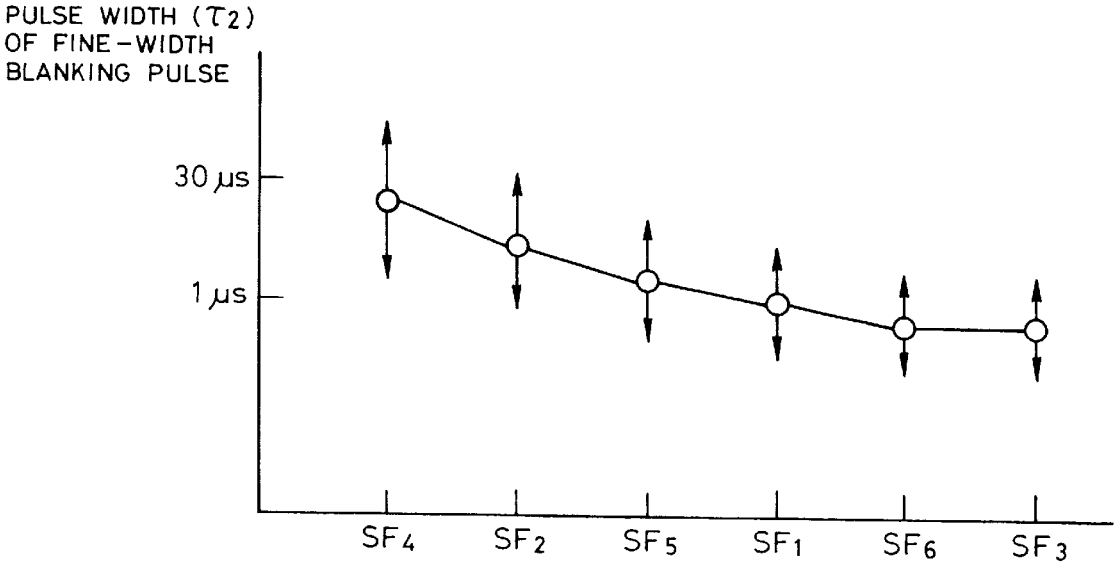
FIG. 6 is a view showing a margin for pulse width of a fine-width blanking pulse.
Figure 7:
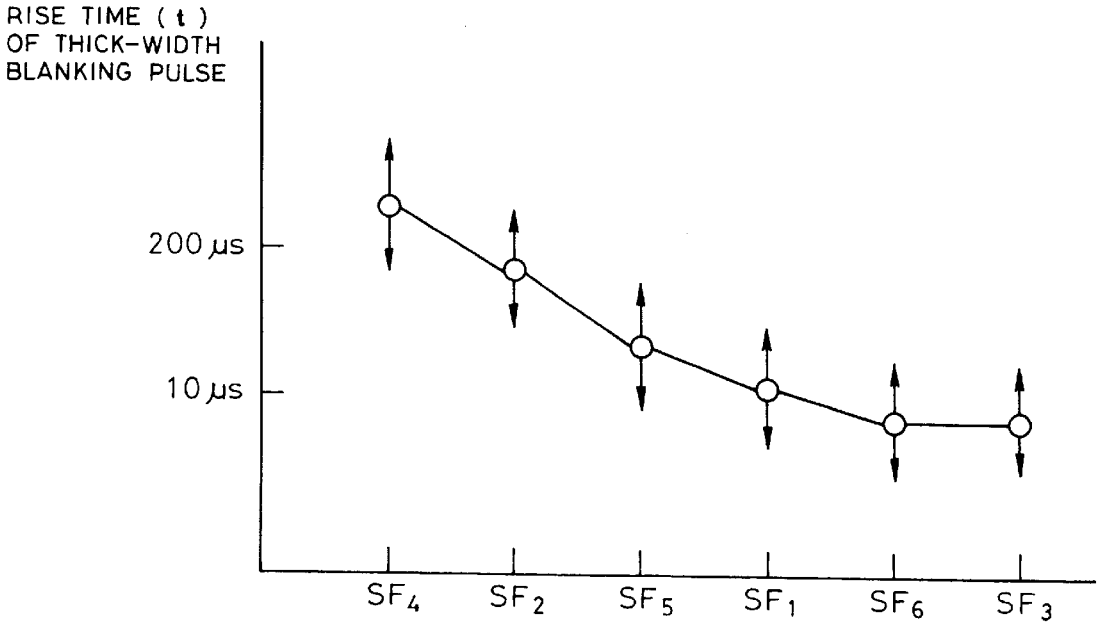
FIG. 7 is a view showing a margin for rise time of the thick-width blanking pulse.

In the present invention, the blanking pulse trains during this maintenance blanking period are structured as below. FIG. 3 is a partially enlarged view showing these blanking pulse trains. In FIG. 3, a first blanking pulse P EC1 is applied to the maintenance electrode, subsequently a second blanking pulse P ES2 is applied to the scanning electrode, a third blanking pulse P EC3 and a fourth blanking pulse P ES4 are likewise applied to each electrode respectively. Of these blanking pulses, the first to third blanking pulses are called fine-width blanking pulses and the fourth blanking pulse is called a thick-width blanking pulse.

The crest value, pulse width and rise time (negative polarity, negative rise), which are parameters by which these blanking pulses are characterized, are indicated by V1 to V4, $\tau 1$ to $\tau 4$ and t in FIG. 3 respectively. Since the optimum values for these values vary as a function of sub-field, as shown in FIGS. 4 to 7, the parameters for blanking pulses for each sub-field SF are determined in accordance with the tendency.

Figure 9:
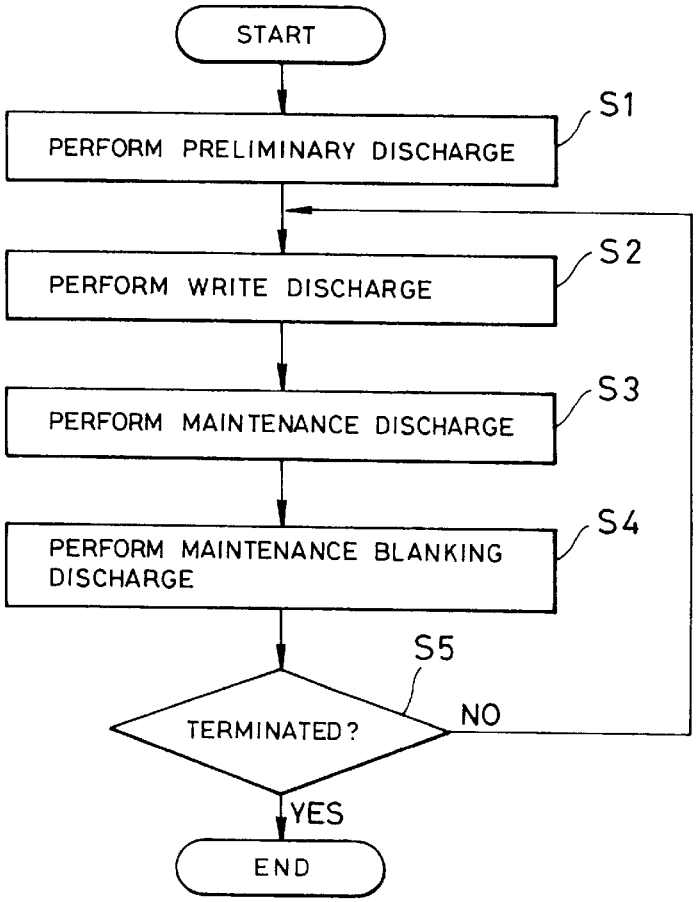
FIG. 9 is a flow chart showing the operation of tonal display.

Next, the operation of the tonal display will be described with reference to FIG. 9.

(1) The entire screen is caused to discharge and emit light once through a preliminary lighting pulse PP during the preliminary discharge period, positive charge, electrons, excitation atoms or molecules are generated within discharge cells to activate the discharge cells, and wall charges on the data electrode, scanning electrode and maintenance electrode are neutralized (blanked) through preliminary blanking pulses P E1, P E2 and P E3 to make preparations for causing the next write discharge with stability (S1).

(2) Scanning pulses Pw are successively applied to a plurality of scanning electrodes during the write period, and in synchronization therewith, a data pulse PD corresponding to the displayed data is applied to generate write discharge, for writing displayed data (S2).

(3) During the maintenance period, maintenance discharge is caused to occur through a maintenance pulse P SUS in accordance with the data written for displaying (S3).

(4) The maintenance discharge is stopped through P EC1, P ES2, P EC3 and P ES4 during the maintenance blanking period, and wall charges on the data electrode, scanning electrode and maintenance electrode are neutralized (blanked) through maintenance blanking discharge to make preparations for stabilizing write discharge for the next sub-field (S4).

(5) If this operation is not terminated (case of NO in S5), the procedure will return to S2 again to repeat the steps to S5, and if the operation is terminated (case of YES in S5), the process is terminated.

By the foregoing process, the tonal display can be performed by causing any sub-field to emit light.

Figure 10:
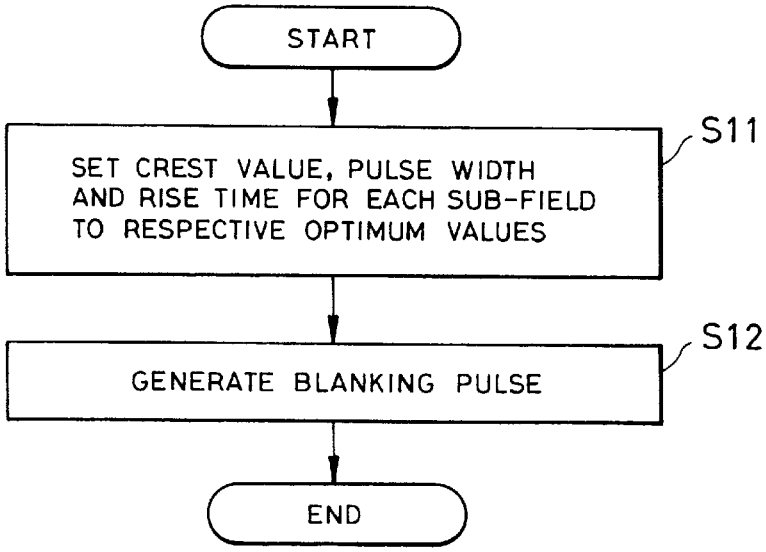
FIG. 10 is a flow chart showing the operation of maintenance blanking discharge.

Next, the operation of maintenance blanking discharge (S4) will be described with reference to FIG. 10.

For the neutralization (blanking) of wall charges during the foregoing maintenance blanking period, optimum values as shown in FIGS. 4 to 7 for the foregoing parameters differ for the respective sub-fields because the sub-fields have different maintenance pulse numbers. Since parameters (shown in FIG. 3) for blanking pulses constituting the maintenance blanking period for each sub-field have been set to the optimum values shown in FIG. 4, the wall charges could be neutralized (blanked) under the optimum conditions in all the sub-fields (S11, S12). As a result, the write characteristics of all the sub-fields were stabilized.

In this respect, as regards the maintenance blanking pulse number, it is qualitatively known that when the pulse number is increased, the maintenance blanking ability is improved. Since, however, the sub-fields exhibit complicated behavior depending on their order of selection and combination, the optimum pulse number was selected by cut-and-try methods. The general view is that the blanking pulse number in the maintenance blanking becomes large when the number of times of emission during the maintenance period is small, and conversely that the blanking pulse number becomes small when the number of times of emission is large.

Figure 8:
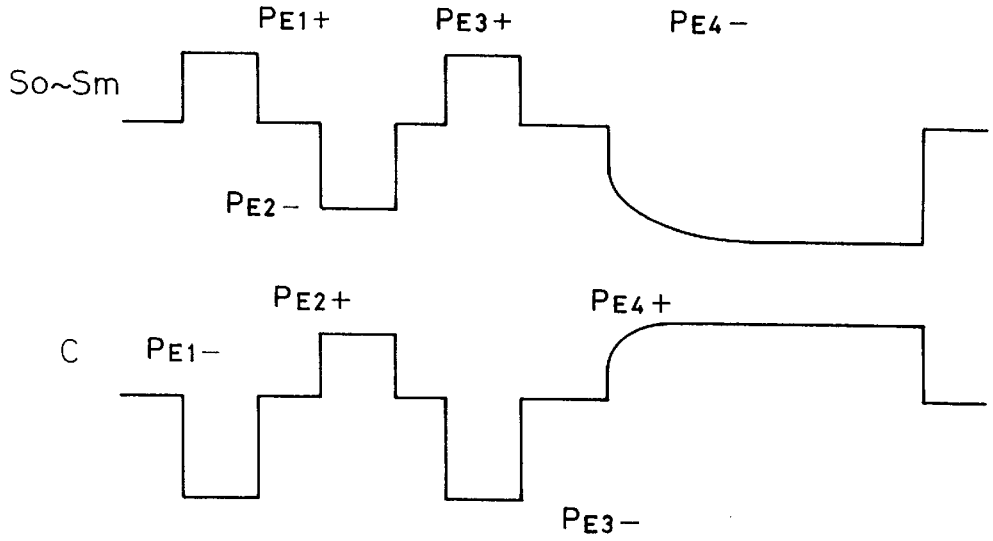
FIG. 8 is a view showing examples of waveform at each portion of another embodiment according to the present invention.

FIG. 8 shows another embodiment according to the present invention, and in this embodiment, the blanking pulse in the previous embodiment is allocated to pulses of positive polarity and negative polarity and applied to the scanning electrode and the maintenance electrode. Since the amplitude of the blanking pulse can be reduced according to this driving method, it becomes possible to lower the dielectric strength of the driving circuit, and to reduce the circuit cost. According to this embodiment, the blanking pulse is applied with plural and different crest values, and therefore, the circuit becomes complicated. Therefore, this is an important technique to provide low-priced products.

As described above, according to the present invention, when a blanking period comprising a plurality of blanking pulses of the optimized parameters is applied for each sub-field, the dependence of the operating margin on the sub-field is eliminated, and the operating margin expands even if the operation is caused to be performed only by one preliminary discharge in one field.

Therefore, it is possible to manufacture a plasma display panel with high-level display contrast in an excellent yield, and to reduce the cost. Also, since the operating margin is large, it is possible to extend the service life, and therefore, it is also possible to provide the products with high reliability at low cost.

What is claimed is:

1. A method for driving a plasma display panel comprising the steps of:

dividing one field period displaying one screen of a plasma display panel into a plurality of sub-fields, each sub-field comprising a write period, a maintenance period and a maintenance blanking period;

setting a maintenance pulse number in each sub-field to a different value to perform tonal display; and setting a plurality of blanking parameters of blanking pulses during said maintenance blanking period of each sub-field in conformity with said maintenance pulse number of said sub-field.

2. A method for driving a plasma display panel according to claim 1, wherein said plurality of blanking parameters comprises as least one of said blanking pulse number, crest value, pulse width and rise time.

3. A method for driving a plasma display panel according to claim 1, further comprising the step of providing preliminary discharge periods for only a subset of said sub-fields.

4. A method for driving a plasma display panel according to claim 3, wherein said sub-fields within one field are arranged in a sequence that differs from a decreasing order of their maintenance pulse numbers.

5. A method for driving a plasma display panel according to claim 1, wherein said blanking pulse comprises a bipolar pulse having positive and negative polarities.

6. A method for driving a plasma display panel according to claim 1, wherein said blanking pulse is supplied to a scanning electrode and a common maintenance electrode.

7. A method for driving a plasma display panel according to claim 3, wherein said preliminary discharge period has been provided for the sub-field at the head.

8. A method for driving a plasma display panel according to claim 4, wherein the sequence of said sub-fields within one field is configured such that a sub-field arranged midway has a larger maintenance pulse number than the other sub-fields.

9. A method for driving a plasma display panel according to claim 8, wherein the sequence of said sub-fields is determined so that the maintenance pulse number stepwise increases in said sub-fields from the head to a middle and the maintenance pulse number stepwise decreases in said sub-fields from the middle to an end.

10. A method for driving a plasma display panel according to claim 1, wherein said blanking pulse is applied to a maintenance electrode and a scanning electrode.

* * * * *